US006369522B1

(12) United States Patent
Collins

(10) Patent No.: US 6,369,522 B1
(45) Date of Patent: Apr. 9, 2002

(54) METAL HALIDE LAMP LUMEN DEPRECIATION IMPROVEMENT

(75) Inventor: Byron R. Collins, Tuxedo, NC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/608,759

(22) Filed: Jun. 30, 2000

(51) Int. Cl.[7] ..... H05B 39/04

(52) U.S. Cl. ..... 315/291; 315/224; 315/307; 313/641

(58) Field of Search ..... 315/291, 224, 315/307, 94, 189, 106, 107, 225, 209 R, 308; 313/636–643

(56) References Cited

U.S. PATENT DOCUMENTS

| | | | | |
|---|---|---|---|---|
| 5,225,742 A | | 7/1993 | Beasley | 315/307 |
| 5,610,447 A | * | 3/1997 | Ivanov et al. | 313/573 |
| 5,773,937 A | * | 6/1998 | Miyazaki et al. | 315/246 |
| 5,796,216 A | | 8/1998 | Beasley | 315/307 |
| 5,821,696 A | * | 10/1998 | Fromm et al. | 315/107 |
| 5,883,475 A | | 3/1999 | Beasley | 315/307 |
| 5,898,273 A | | 4/1999 | Collins et al. | 313/638 |
| 5,909,082 A | | 6/1999 | Speaker et al. | 313/570 |
| 5,914,571 A | | 6/1999 | Beasley | 315/244 |
| 5,942,850 A | * | 8/1999 | Rutan et al. | 313/571 |
| 5,949,192 A | * | 9/1999 | Kominami et al. | 315/94 |
| 5,990,633 A | * | 11/1999 | Hirshmann et al. | 315/289 |

OTHER PUBLICATIONS

Straight Talk (About HID Lighting), G.E. Lighting Systems, Apr. 1993.

GE HID Lamps, GE Pulse ARC™ Multi–Vapor© Lamps, Apr. 1997.

Starting Mechanisms for HID Lamps, B. R. Collins, May 1994.

Pulse Start of Metal Halide Lamps for Improved Lumen Maintenance (Nortrup et al.—OSRAM SYLVANIA INC. (Paper for 1995 IES Conference). Citations—Nerac—Search Report Jun. 1999.

Specifications—Ultraviolet Radiation Exposure, Osram Sylvania, Oct. 1995.

Pulse Start Metal Halide Systems, 5/97.

Product information bulletin on 400 WATT SUPER META-LARC® Pulse Start Metal Halide Lamp, Osram Sylvania, Oct. 1995.

* cited by examiner

*Primary Examiner*—Don Wong
*Assistant Examiner*—Ephrem Alemu
(74) *Attorney, Agent, or Firm*—Fay, Sharpe, Fagan, Minnich & McKee, LLP

(57) ABSTRACT

A ballast and metal halide lamp circuit improvement designed to reduce lamp lumen depreciation over the life of the lamp, wherein the circuit comprises a high frequency electronic ballast configured to generate high voltage starting pulses, and a metal halide lamp further comprising an arc tube containing an ionizable medium, and having main electrodes sealed into opposed ends of the arc tube, the ionizable medium including mercury, a metal halide, and an inert gas selected from the group consisting of argon, krypton, and xenon and mixtures thereof, wherein the starting pulses are suitable for starting high fill pressure metal halide lamps, and said inert gas is at a cold pressure of greater than 50 torr.

20 Claims, 6 Drawing Sheets

METAL HALIDE LAMP LUMEN DEPRECIATION IMPROVEMENT

FIELD OF INVENTION

The present invention relates to improving the lamp lumen depreciation performance of metal halide HID lamps. More particularly, the invention relates to much improved lamp lumen depreciation performance of Pulse Arc Metal Halide lamps when used with an electronic ballast.

BACKGROUND OF THE INVENTION

There has been an industry wide problem in meeting lamp lumen depreciation (LLD) specifications for metal halide (MH) lamps for some time now. In general, the LLD performance has been lower than rated or desirable, and considerable effort over the last 30 years has been spent on trying to solve this problem. Two independent efforts to solve this problem have involved a new lamp/ballast system called Pulse Arc or Pulse Start and separate work on electronic ballasts to improve the performance of standard MH lamps.

The first effort involves increasing the fill pressure in the arc tube of a MH lamp, using a shaped arc tube and eliminating the starter electrode and associated components (bi-metal switch and resistor). An igniter pulse-forming network is then required to start this new lamp. The system is generally referred to as Pulse Arc or Pulse Start.

The second effort involves the use of a high frequency electronic ballast where the 60 Hz output frequency is replaced with a 90 kHz output frequency with a sine wave of voltage and current. One example of a ballast designed to operate lamps at 90 kHz is a Delta Power ballast (Delta Power Supply, Inc.). We have found through testing that this ballast will generally improve the LLD of standard MH lamps.

It would be desirable to combine the two aforementioned efforts to compound the benefits of both efforts for greater improvements than either effort by itself can provide, however, an impediment to combining the efforts has been that the available high frequency ballasts were not designed to operate Pulse Arc lamps and would not start them.

A desirable aspect of the present invention is that it provides the advantages and compounded benefits of both heretofore uncombined efforts to improve LLD performance of MH lamps. Still a further desirable aspect of the present invention is that it provides the compounded benefits to as wide a range of lamp wattages as possible, thereby simplifying the design of lamp/ballast lighting systems in general.

SUMMARY OF THE INVENTION

In an embodiment of the present invention,. a high frequency 90 kHz electronic ballast is used to provide starting pulses capable of starting Pulse Arc MH and Pulse Start MH lamps. The ballast is further designed to operate the aforementioned lamps at wattages at least as high as 400 watts. The combination of Pulse Arc and Pulse Start MH lamps with a modified 90 Khz electronic ballast provides LLD performance for MH lamps previously unmatched in the industry.

DETAILED DESCRIPTION OF THE INVENTION

Figure 1:
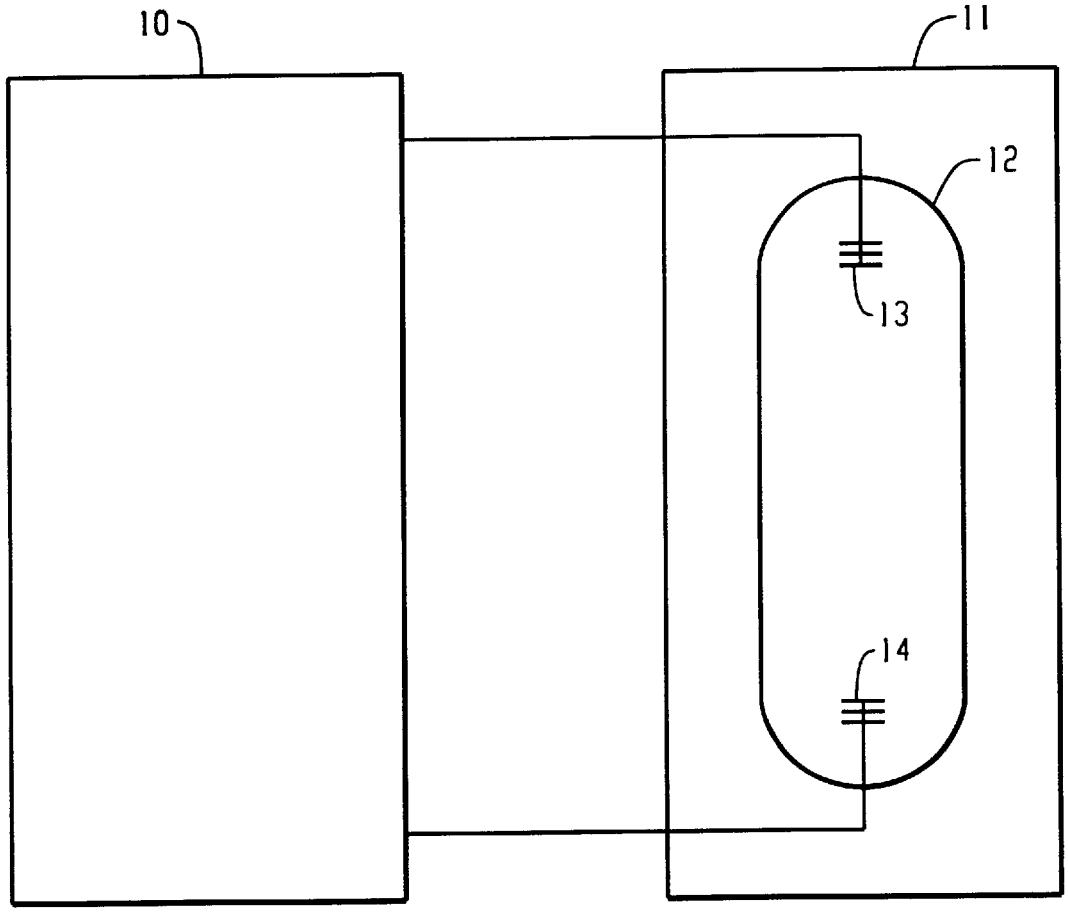
FIG. 1 is a schematic representation of a metal halide lamp and ballast circuit configuration.

FIG. 1 provides a schematic representation of a metal halide lamp circuit configuration that is suitable for application to an embodiment of the present invention. The configuration illustrated in FIG. 1 is also exemplary of configurations described below that were used for proving the advantages of the present invention. With reference to FIG. 1, a ballast 10, configured to generate high voltage starting pulses, is connected to a metal halide lamp 11 that contains an arc tube 12 that has main electrodes 13, 14 sealed into opposing ends of arc tube 12. The first electrode 13 is connected to one terminal of ballast 10, and the remaining electrode 14 is connected to the remaining terminal of ballast 10. In all references to ballasts and metal halide lamps in the following discussion it is to be assumed that each ballast and metal halide lamp assumes the position of ballast 10 and metal halide lamp 11 respectively.

Figure 2:
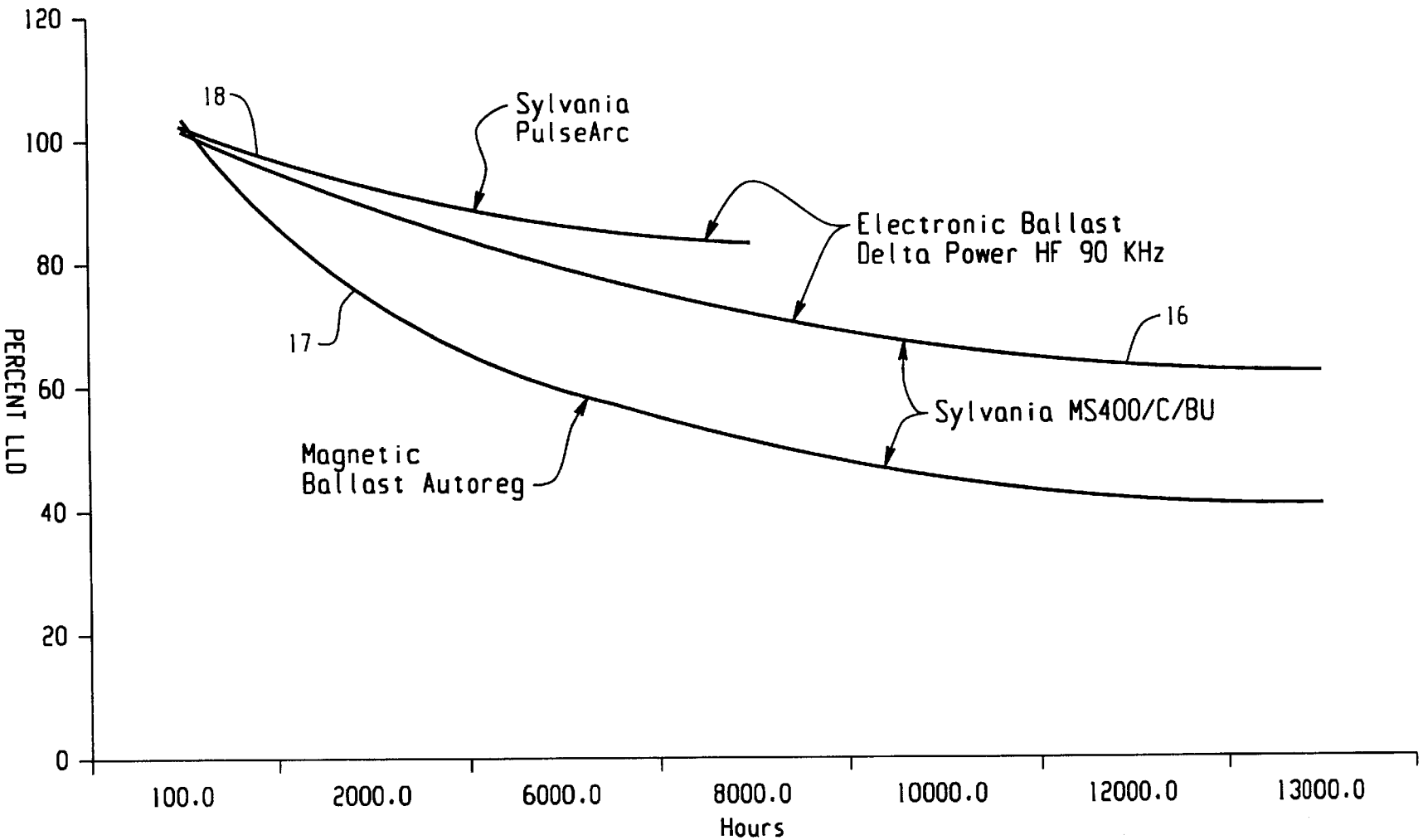
FIG. 2 is a graphical summary of a life test for a Sylvania PulseArc lamp and MS400/C/BU lamps operated on Delta Coventry electronic ballasts and a magnetic ballast.

FIG. 2 summarizes the results of testing standard Sylvania MH 400 watt lamps of type MS400/C/BU on two different types of ballast, a Delta Power HF 90 Khz electronic ballast and a magnetic ballast (autoreg). Lamp lumen depreciation (LLD) data was collected through 13,000 hours of operation. The curve 16 represents the average trend for lamps on the electronic ballast and the curve 17 represents the average trend for lamps on the magnetic ballast. The results show that the average degradation, in terms of LLD, for lamps on the electronic ballast was approximately only 40 percent that for lamps on the magnetic ballast after 13,000 hours of operation. This test exemplifies typical improvements in LLD performance for this type of lamp when placed on a high frequency electronic ballast. FIG. 2 also shows the average trend for Sylvania PulseArc lamps on the electronic ballast, and this trend is shown as the curve 18. Data for the PulseArc lamp was only collected through 8,000 hours of operation, however, trend curve 18 also shows improved performance over lamps on the magnetic ballast.

Figure 3:
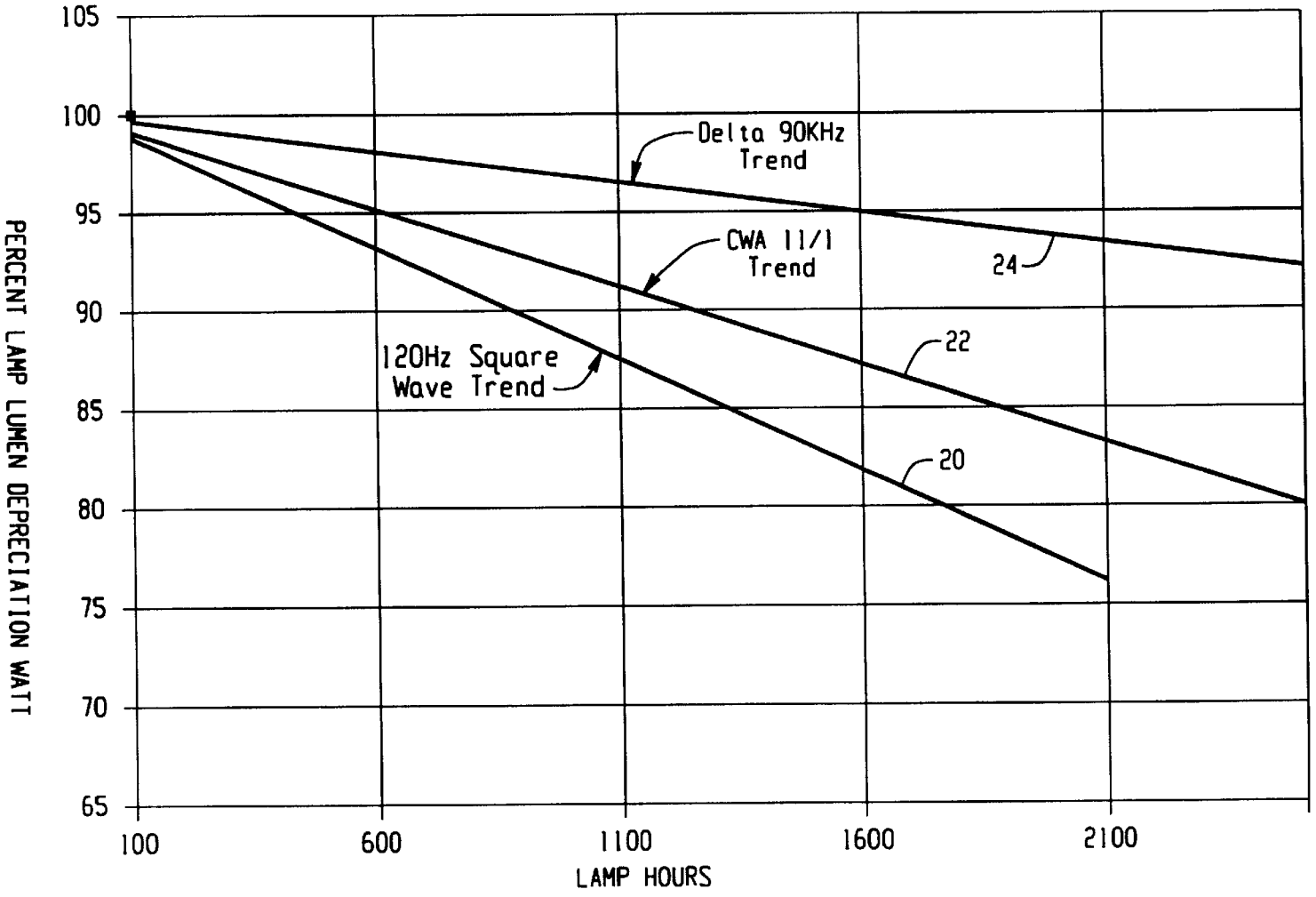
FIG. 3 is a graphical lumen performance comparison of M400/U lamps operated on CWA ballasts, Delta 90 kHz electronic ballasts and 120 Hz square wave ballasts.

FIG. 3 summarizes the results of testing standard Sylvania MH 400 watt lamps of type M400/U on a 120 Hz square wave electronic ballast, a Delta 90 kHz electronic ballast and a Constant Wattage Autoregulator (CWA) ballast. The trend for lamps on the 120 Hz square wave ballast is identified by the lowest solid line 20, the trend for lamps on the CWA ballast is identified by the middle solid line 22, and the trend for lamps on the 90 kHz electronic ballast is identified by the uppermost solid line 24. The lamps were all operated on 11/1 cycles twice a day, meaning 11 hours on followed by a 1 hour cooldown, repeated twice daily. The results show dramatically poorer performance for lamps on the 120 Hz square wave ballast when compared to either of the other two ballasts. The mix of high frequency components inherent to a square wave induce acoustic resonance within the lamps, causing the arc to be unstable, wandering on the electrode. The results of the test were so poor that the test was terminated after 2,100 hours.

Figure 4:
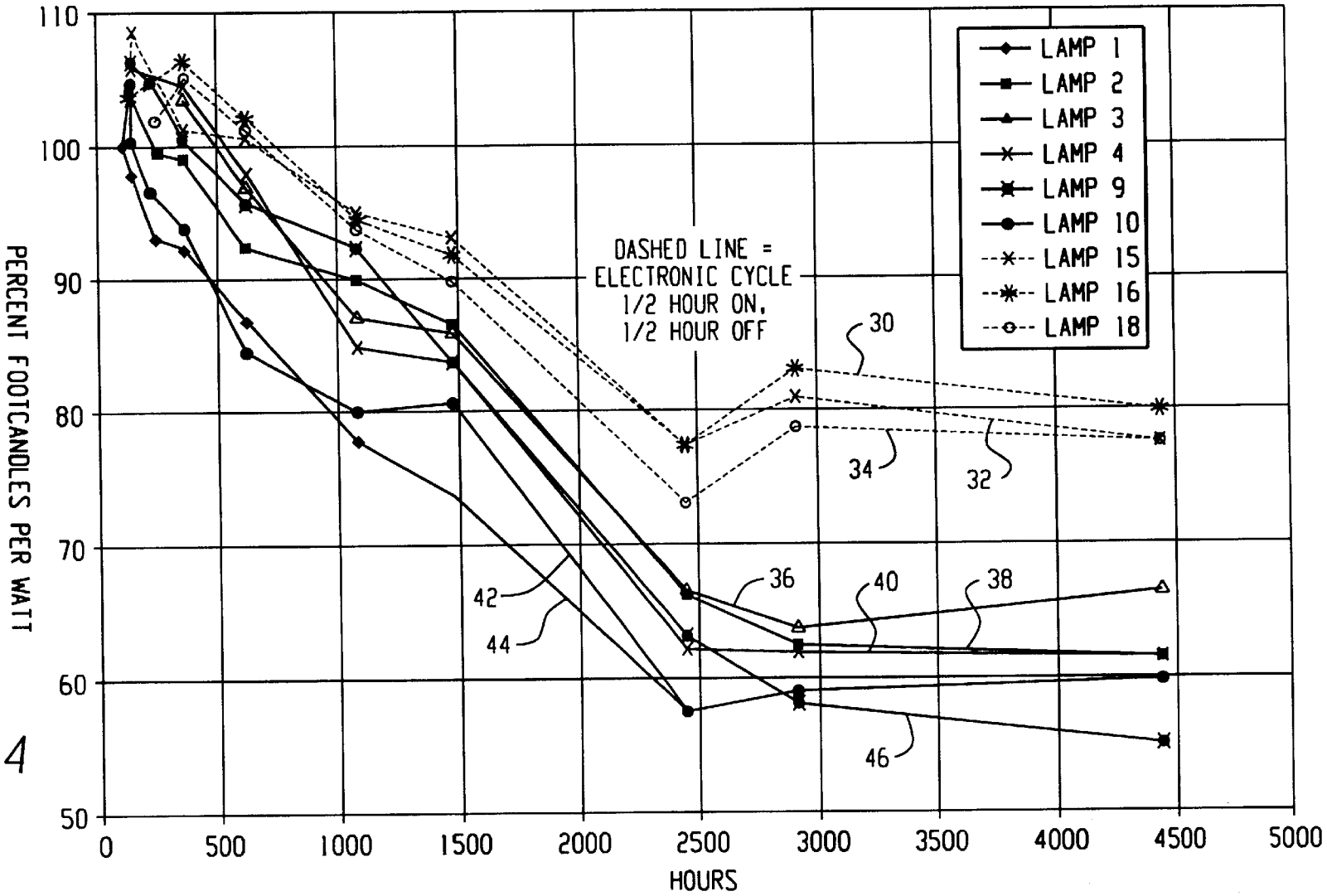
FIG. 4 is a graphical lumen performance comparison of electronic ballasts versus magnetic ballasts.

There is existing literature claiming that electronic ballasts improve the LLD performance of low wattage MH lamps compared to their performance on standard magnetic ballasts. A test was performed to confirm the existing literature. FIG. 4 consists of plots of percent foot-candles per watt versus time for individual MH 70 watt lamps tested on Aromat electronic 170 Hz square wave ballasts manufactured by Aromat Corporation and standard magnetic ballasts. Dashed lines 30, 32 and 34 represent lamps tested on Aromat electronic ballasts. Solid lines 36, 38, 40, 42, 44 and 46 represent lamps tested on magnetic ballasts. The test was started with six lamps on each ballast, however, three electronic ballasts failed during the test. This test showed a two to one improvement in terms of foot-candle degradation for lamps powered by electronic ballasts compared to lamps powered by magnetic ballasts, however, the electronic ballast was specially modified to remove high frequency components from the square wave; in other words the corners were rounded. Arguably, the 120 Hz square wave ballast used in FIG. 3 may have yielded better performance if similar modifications had been made. This test shows that, for low power MH lamps on electronic ballasts, the foot-candle intensity is nearly 80 percent of the original intensity after 4,500 hours of operation under repeated cycles of ½ hour on followed by ½ hour off.

Figure 5:
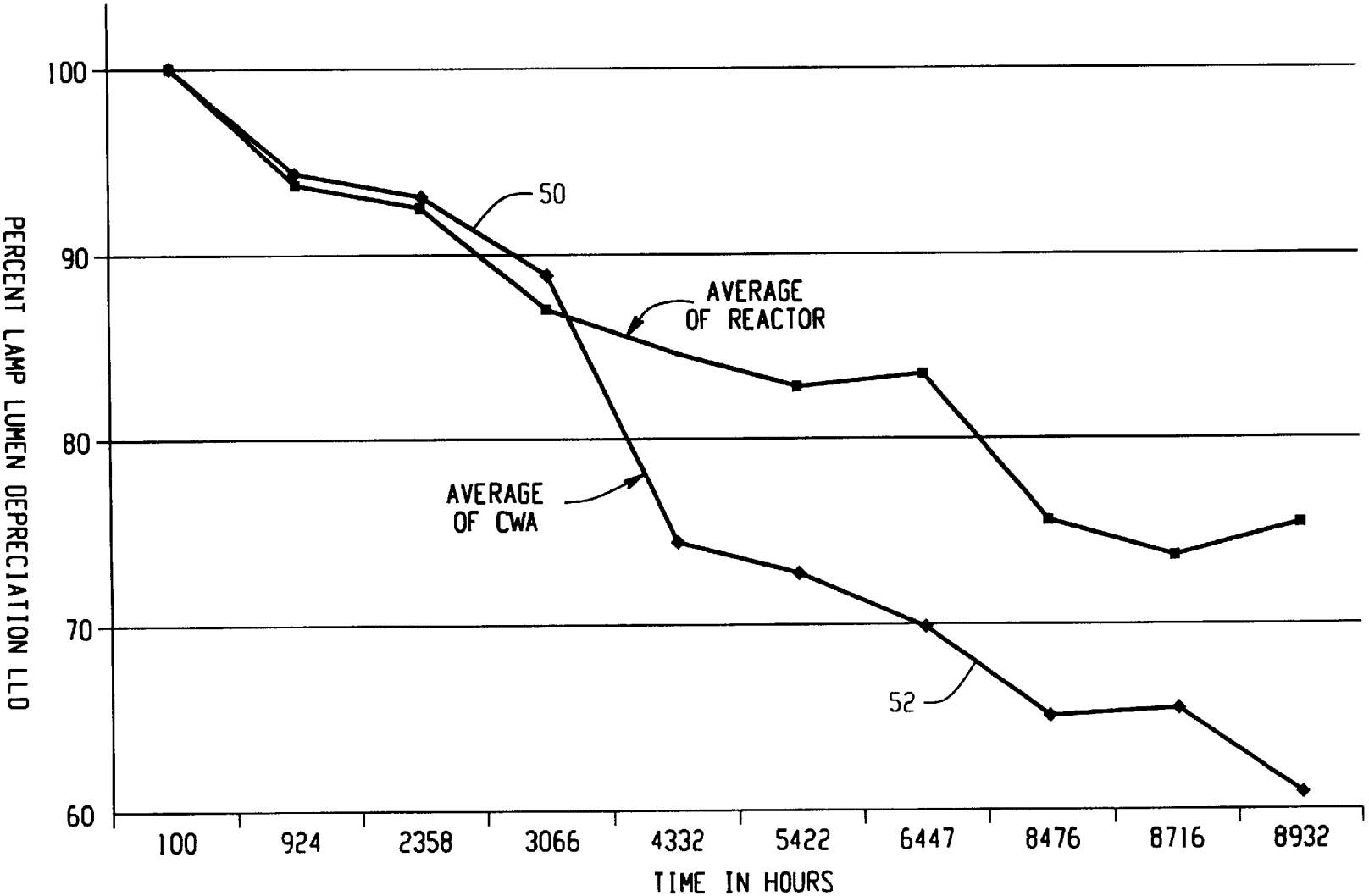
FIG. 5 is a graphical lumen performance comparison of GE CWA ballasts versus Advance reactor ballasts; and, FIG. 6 is a graphical lumen performance comparison of MH lamps operated continuously versus cycled on and off.

Because failing to meet LLD ratings has been an industry-wide issue for some time now, benchmarking tests of LLD performance for MH lamps on magnetic ballasts was deemed necessary to establish accurate standards on which to base comparisons quantifying the improvements provided by the present invention. FIG. 5 depicts graphically the results of one such benchmarking test using six Osram Sylvania Inc. (OSI) 320 watt MH lamps, three on one-coil reactor ballasts and three on CWA ballasts. The graph shows LLD depreciation versus hours. The average results for lamps energized by the reactor ballasts are shown by line 50. The average results for lamps energized by the CWA ballasts are depicted by line 52. While this test is not statistically significant in comparing reactor ballasts to CWA ballasts because of the small number of lamps tested, it does show that the LLD performance of the lamps on the CWA ballasts dropped dramatically after 3,000 hours and was below published standards (66% LLD) for the lamps at 8,000 hours. The performance in terms of LLD of lamps on the reactor ballasts was above the published standards at 8,000 hours.

Figure 6:
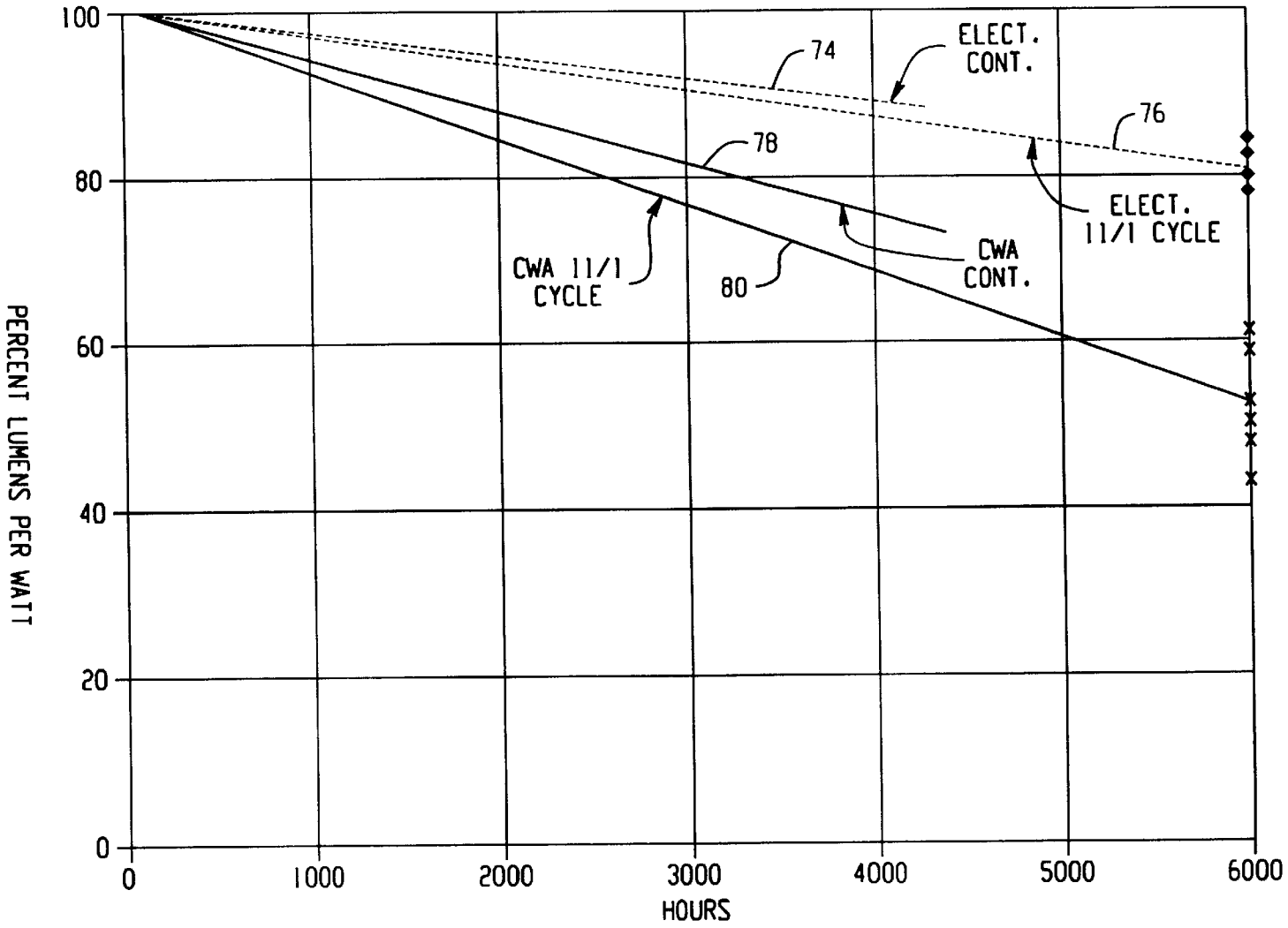

FIG. 6 illustrates the effects of starting lamps on their performance in terms of LLD on electronic ballasts and CWA ballasts. The cycled lamps used an 11/1 cycle, eleven hours on followed by one hour off. All lamps were OSI 400 watt MH lamps. Bold dashed line 74 represents the trend for lamps operated continuously on electronic ballasts. Dashed line 76 represents the trend for lamps cycled 11/1 on electronic ballasts. Bold solid line 78 and solid line 80 represent, respectively, trends for lamps operated continuously and cycled 11/1 on CWA ballasts. The trends show that cycling lamps contributes to their deterioration. Comparable results were found with another major lamp manufacturer's lamps, showing comparable improvements in LLD.

In explaining the improved performance offered by the present invention, wherein a 90 kHz electronic ballast is combined with MH Pulse Arc lamps, there are two advantages worth considering. The first advantage comes from the effects of fill pressure in the arc tube. Low fill pressures give rise to unacceptably high levels of sputtering damage at startup due to the long mean free path of the gas in the arc tube. Increasing the fill pressure reduces sputtering, however, standard 320 volt ballasts will not start a MH lamp with fill pressures in excess of approximately 33 torr. Pulse Arc lamps allow up to 100 torr but require starting voltages of at least 3,000 volts, however, the high fill pressure reduces sputtering damage, increasing the LLD performance of the lamp.

The second advantage comes from the effects of frequency on LLD performance. The two arc tube electrodes alternately serve as cathodes and anodes during successive halves of the alternating voltage cycles. When an electrode is serving the role of a cathode, emitting electrons, the electrons are emitted from a very small spot with a current density of approximately 10,000 amps per square millimeter. This high current density gives rise to an almost molten spot of tungsten at a temperature of approximately 2,800 K. The upside to this is that the hot tungsten can emit up to 3 amps of current with only a 10 volt drop, increasing the efficiency of the lamp. To support a 2,800 K hot spot on the tungsten, the electrode must be operating at a minimum temperature of 1,400 K. A cooler electrode chills the hot spot, thereby losing the efficiency advantages provided by the hot spot. While serving as an anode, there is no hot spot because the electrons arrive randomly over the entire surface of the electrode.

Therefore, a factor in maintaining the hot spot is the frequency of operation because the electrode hot spot is cooling while operating as an anode, making it more difficult to maintain the hot spot. Operating at a line frequency of 60 Hz causes each electrode to serve alternately as a cathode and an anode for 8 milliseconds each. This is a long period of time in terms of the amount of cooling that can occur during operation as an anode. However, a high frequency electronic ballast, operating at 90 kHz, only allows the electrode to operate as an anode for 5.5 microseconds which greatly facilitates maintaining the electrodes at a high temperature with little variation during alternating halves of the cycle. It is the compounding of the above disclosed independent advantages that provides the exceptional and unexpectedly good performance of Pulse Arc MH lamps in combination with electronic sine wave 90 kHz ballasts modified for starting Pulse Arc lamps.

While the invention has been described with respect to specific embodiments by way of illustration, many modifications and changes will occur to those skilled in the art. It is therefore to be understood that the appended claims are intended to cover all such modifications and changes as fall within the true spirit and scope of the invention.

What is claimed is:

1. A ballast and metal halide lamp circuit configuration designed to reduce the lamp lumen depreciation over the life of the lamp, the circuit comprising:

a high frequency electronic ballast configured to generate high voltage starting pulses; and a metal halide lamp rated at 400 watts or greater comprising:

an arc tube containing an ionizable medium, and having main electrodes sealed into opposed ends of the arc tube, the ionizable medium including mercury, a metal halide, and an inert gas selected from the group consisting of argon, krypton, and xenon and mixtures thereof, wherein said inert gas is at a cold pressure of greater than 50 torr, wherein the starting pulses are suitable for starting high fill pressure metal halide lamps.

2. The circuit of claim 1, wherein said ballast operates at a frequency greater than 120 Hz.

3. The circuit of claim 1, wherein said ballast operates at a frequency at least of 90 kHz.

4. The circuit of claim 1, wherein said ballast generates starting pulses of at least 3,000 volts.

5. The circuit of claim 1, wherein said ballast generates a sine wave output.

6. The circuit of claim 1, wherein said inert gas is at a cold pressure of at least 100 torr.

7. The circuit of claim 1, wherein said metal halide lamp requires starting pulses of greater than 320 volts.

8. The circuit of claim 1, wherein said metal halide lamp requires starting pulses of at least 3,000 volts.

9. A method of reducing the lamp lumen depreciation of a metal halide lamp over the life of the lamp, the method comprising:

generating a high frequency waveform from an electronic ballast configured to generate a high voltage starting pulses; and energizing a metal halide lamp rated at 400 watts or greater with said high frequency waveform, said metal halide lamp comprising:

an arc tube containing an ionizable medium, and having main electrodes sealed into opposed ends of the arc tube, the ionizable medium including mercury, a metal halide, and an inert gas selected from the group consisting of argon, krypton, and xenon and mixtures thereof, wherein said inert gas is at a cold pressure of greater than 50 torr, wherein the starting pulses are suitable for starting high fill pressure metal halide lamps.

10. The method of claim 9, further including operating the ballast at a frequency greater than 120 Hz.

11. The method of claim 9, further including operating the ballast at a frequency at least of 90 kHz.

12. The method of claim 9, wherein said metal halide lamp requires starting pulses of greater than 320 volts.

13. The method of claim 9, wherein said metal halide lamp requires starting pulses of at least 3,000 volts.

14. The method of claim 9, wherein said ballast generates starting pulses of at least 3,000 volts.

15. The method of claim 9, wherein said inert gas is at a cold pressure of at least 100 torr.

16. A method of reducing the lamp lumen depreciation of a metal halide lamp over the life of the lamp, the method comprising:

generating a high frequency waveform from an electronic ballast configured to generate high voltage starting pulses, a selected frequency of the high frequency waveform being other than equal to an acoustic resonant frequency of the metal halide lamp; and energizing a metal halide lamp with said high frequency waveform, the metal halide lamp comprising:

an arc tube containing an ionizable medium, and having main electrodes sealed into opposed ends of the arc tube, the ionizable medium including mercury, a metal halide, and an inert gas selected from the group consisting of argon, krypton, and xenon and mixtures thereof, wherein said inert gas is at a cold pressure of greater than 50 torr, wherein the starting pulses are suitable for starting high fill pressure metal halide lamps.

17. The method of claim 16, further including operating the ballast at a frequency greater than 120 Hz.

18. The method of claim 16, further including operating the ballast at a frequency at least of at least 90 kHz.

19. The method of claim 16, wherein the electrodes alternatively operate an anodes for approximately 5.5 micro seconds for a 90 kHz signal.

20. The method of claim 9, wherein the metal halide lamp is rated at 400 watts or greater.

* * * * *